US007329067B1

(12) United States Patent
Rodriguez

(10) Patent No.: US 7,329,067 B1
(45) Date of Patent: Feb. 12, 2008

(54) RETRACTABLE ROAD MEDIAN

(75) Inventor: Juan Rodriguez, Medley, FL (US)

(73) Assignee: Pichy Welding Machine Shop, Corp., Miami, FL (US)

( * ) Notice: Subject to any disclaimer, the term of this patent is extended or adjusted under 35 U.S.C. 154(b) by 0 days.

(21) Appl. No.: 11/737,544

(22) Filed: Apr. 19, 2007

(51) Int. Cl.
*E01F 13/00* (2006.01)

(52) U.S. Cl. ..... 404/6; 49/33; 49/49; 49/131; 256/13.1

(58) Field of Classification Search ..... 49/33, 49/49, 131; 404/6; 256/13.1
See application file for complete search history.

(56) References Cited

U.S. PATENT DOCUMENTS 1,884,447 A * 10/1932 White ..... 256/1
3,531,895 A * 10/1970 Appell ..... 49/360
4,576,507 A * 3/1986 Terio ..... 404/6
4,577,991 A 3/1986 Rolow
4,666,331 A 5/1987 Riley
4,822,207 A * 4/1989 Swahlan ..... 404/6
5,009,542 A 4/1991 Hardin, Jr. et al.
5,551,796 A * 9/1996 Anderson et al. ..... 404/6
2007/0183845 A1* 8/2007 Lewis ..... 404/6

* cited by examiner

*Primary Examiner*—Gary S. Hartmann
(74) *Attorney, Agent, or Firm*—Albert Bordas, P.A.

(57) ABSTRACT

A retractable road median used to divide a road that may be retracted to allow vehicles to cross it in the event of an emergency, comprising a median assembly, a frame assembly, a winch assembly, and a longitudinal base assembly. The retractable road median has means to move the median assembly from a retraced position into an extracted position and vise versa. In the retracted position, a cavity built underneath a road surface, retractably receives the median assembly therein. The longitudinal base assembly includes two angled lateral walls that, in the extracted position, are in a substantially vertical disposition and their longitudinal edges rest on the sidewalls of the median assembly. In the retracted position, the median assembly collapses into the cavity so that the angled lateral walls rotate into a nearly horizontal position to cover the cavity entrance, permitting vehicles to cross to the other side.

14 Claims, 7 Drawing Sheets

RETRACTABLE ROAD MEDIAN

BACKGROUND OF THE INVENTION

1. Field of the Invention

The present invention relates to roadway medians, and more particularly, to a road median that may be retracted to allow vehicles to cross over it in the event of an emergency or when desired.

2. Description of the Related Art

In the event of an emergency, every second counts and can be the difference between life and death for a person in need. Dividing expressway barriers, or road medians, serve a useful purpose, in that they effectively divide a roadway to prevent head-on collisions between vehicles traveling in opposite directions. However, while effectively serving that purpose, dividing expressway barriers also prevent vehicles from crossing over in the event of an emergency. In certain instances, authorized vehicles such as, but not limited to law enforcement, the fire department, and rescue personnel have the need to cross a dividing expressway barrier.

Several designs for road medians have been designed in the past. None of them, however, are retractably mounted and secured over a cavity of cooperative dimensions and shape to receive a road median when lowered therein, to allow emergency vehicles to cross over it, whereby the road median is used to divide a road such as an expressway.

Applicant believes that the closest reference corresponds to U.S. Pat. No. 5,009,542 issued to Hardin, Jr., et al. on Apr. 23, 1991 for a traffic barrier gate. However, it differs from the present invention, because Hardin, Jr., et al. teach a traffic barrier gate for controlling the flow of vehicles through a barrier, such as a concrete median wall between opposing traffic lanes of a controlled access highway. In one embodiment, the gate comprises hinged sidewall panels connected to a support member which is moved vertically on command and which, when moved, causes the sidewall panels to collapse and spread out thereby forming a ramp for the passage of vehicles through the wall barrier. In a second embodiment, the gate revolves 180 degrees upon command, and then retracts into a well in the ground thereby forming the traffic ramp.

Applicant believes that another related reference corresponds to U.S. Pat. No. 4,666,331 issued to Riley on May 19, 1987 for an instant defense barrier. However, it differs from the present invention, because Riley teaches an instant defense barrier for providing unobtrusive protection for a building or other site. A plurality of barrier post assemblies are anchored in the earth. Each assembly includes a barrel and a post slidably fitted in the barrel. The head end of the post portion is essentially flush with the level of the roadbed when the post is in the normal, non-extended position. When activated by closing a switch, the post is propelled from the confined position in the barrel by an explosive charge, a compression spring or other propulsive forces to a locked extended position to provide a barrier against unauthorized passage by a motor vehicle. A plurality of auxiliary cables that are optionally connected between adjacent posts provide further obstruction to the progress of small vehicles, such as motorcycles or bicycles.

Applicant believes that another related reference corresponds to U.S. Pat. No. 4,577,991 issued to Rolow on Mar. 25, 1986 for a deployable vehicular barricade instant defense barrier. However, it differs from the present invention, because Rolow teaches a deployable vehicular barricade system that includes a plurality of barricade units, each having an elongated rigid post, slidably received in a below-grade casing. Longitudinally spaced guide plates cooperating between the post and the casing guide the post between an extended position partially projecting from the casing and a retracted position within the casing and also serve to resist vehicular impact to the post in the extended position. A spring in the bottom of the casing and a remotely controlled locking arm and trigger mechanism allow the post to be selectively and instantaneously deployed into the extended position.

Other patents describing the closest subject matter provide for a number of more or less complicated features that fail to solve the problem in an efficient and economical way. None of these patents suggest the novel features of the present invention.

SUMMARY OF THE INVENTION

The instant invention is a retractable road median, comprising a median assembly having a substantially flat top wall, sidewalls, and a base. The sidewalls are in a parallel and spaced apart relationship with respect to each other and they have longitudinal top edges. The top wall is in a parallel and spaced apart relationship with respect to the base, and the base has ends. The median assembly serves as a traffic barrier for controlling a flow of motor vehicles between opposing traffic lanes on a road.

A frame assembly comprises side frames having transversal walls that form first and second H cross-sections. The frame assembly also comprises a base. The first and second H cross sections each defining a channel or rail where the median assembly travels vertically upon. The frame assembly further comprises angled lateral walls that are fixed to the side frames.

A longitudinal base assembly comprises its angled lateral walls and respective sidewalls extending therefrom and longitudinal edges. The angled lateral walls are in a predetermined obtuse angle with respect to the sidewalls and the angled lateral walls are hingedly mounted to supporting frames respectively with longitudinal hinges that are fixed to the sidewalls. The sidewalls are at a substantially vertical disposition and the longitudinal edges rest on the sidewalls when the median assembly is in the extracted position.

A winch assembly has means to retract the median assembly into a cavity below a surface traveled upon by motor vehicles from an extracted position to a retracted position, to allow the motor vehicles to cross over it, and vise versa.

The angled lateral walls collapse inwardly into a nearly horizontal position and onto the top wall when the median assembly is in the retracted position. The frame assembly comprises at least one impact mount mounted onto the base.

The winch assembly comprises pulleys that are positioned to cooperate with a cable that vertically moves the median assembly when the winch assembly is actuated. One pulley is mounted adjacent to a through opening the other pulleys are mounted in proximity to their respective ends on the base. The winch assembly further comprises spacer wheels that are rotatably mounted to upper corners of one sidewall. The spacer wheels prevent the median assembly from erratic movement through each channel or rail.

The means to retract the median assembly into the cavity includes introducing a removable handle to disengage a release lever thus allowing the median assembly to travel downwardly by gravity as the cable unwinds, until the median assembly is in the retracted position. In this position, the angled lateral walls rotate and lay in a substantially horizontal position, thus creating a ramp or bridge, to permit motor vehicles to travel over them. The means to extract the median assembly from the cavity includes introducing the removable handle to apply a rotational force, causing the cable to wind upon a reel until the median assembly is in a the extracted position as the sidewalls are at a substantially vertical disposition and the longitudinal edges rest on the sidewalls respectively.

It is therefore one of the main objects of the present invention to provide a retractable road median that that may be retracted into a cavity to allow authorized vehicles to cross it in the event of an emergency or when desired.

It is another object of this invention to provide a retractable road median that is retractably mounted and secured over a cavity of cooperative dimensions and shape to house the road median when lowered therein.

It is another object of this invention to provide a retractable road median that includes hingedly mounted angled lateral walls, which rotate and lay in a substantially horizontal position to close a cavity opening, thereby permitting authorized vehicles to travel thereover.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
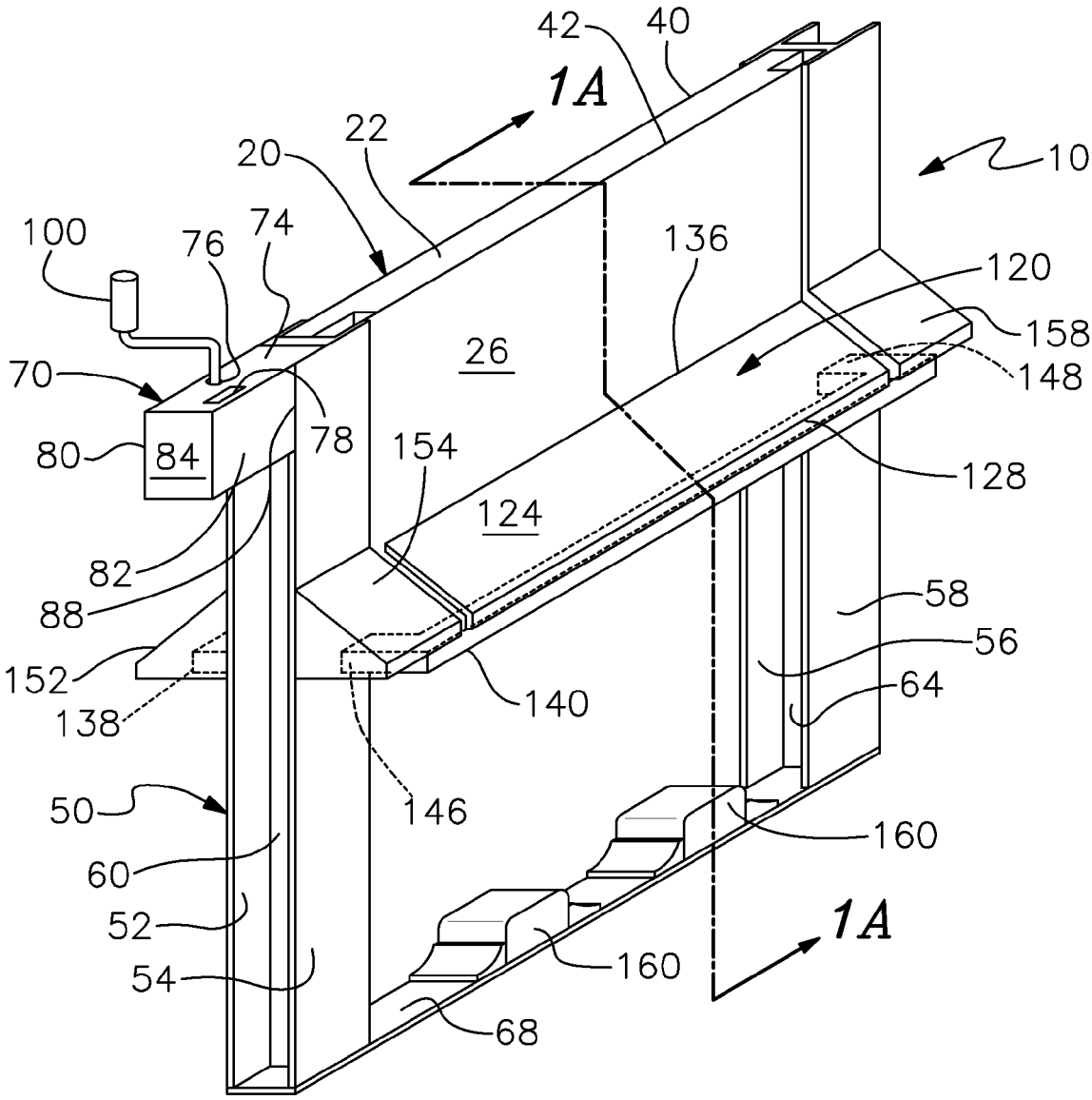
FIG. 1 illustrates an isometric view of the retractable road median in an extracted position.

Referring now to the drawings, the retractable road median is generally referred to with numeral 10 and it basically includes median assembly 20, frame assembly 50, winch assembly 70, and longitudinal base assembly 120.

The retractable road median 10 is used as means to divide a road such as an expressway. Yet, instant invention 10 may be retracted to allow authorized vehicles to cross over it in the event of an emergency or when desired. The road median is defined as a traffic barrier for controlling the flow of vehicles with a barrier, such as a concrete median wall between opposing traffic lanes of a controlled access highway. Such authorized vehicles may be, but are not limited to, law enforcement, the fire department, and medical personnel.

Figure 1B:
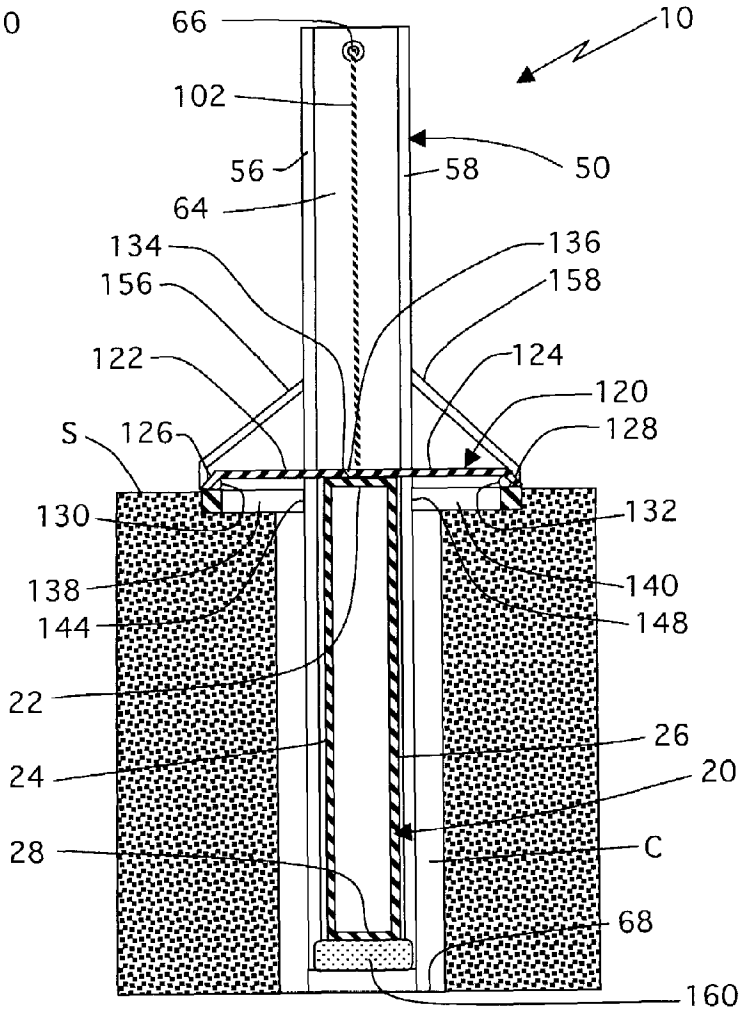
FIG. 1B illustrate the cross sectional view of FIG. 1A, when the instant invention is in a retracted position.
Figure 1A:
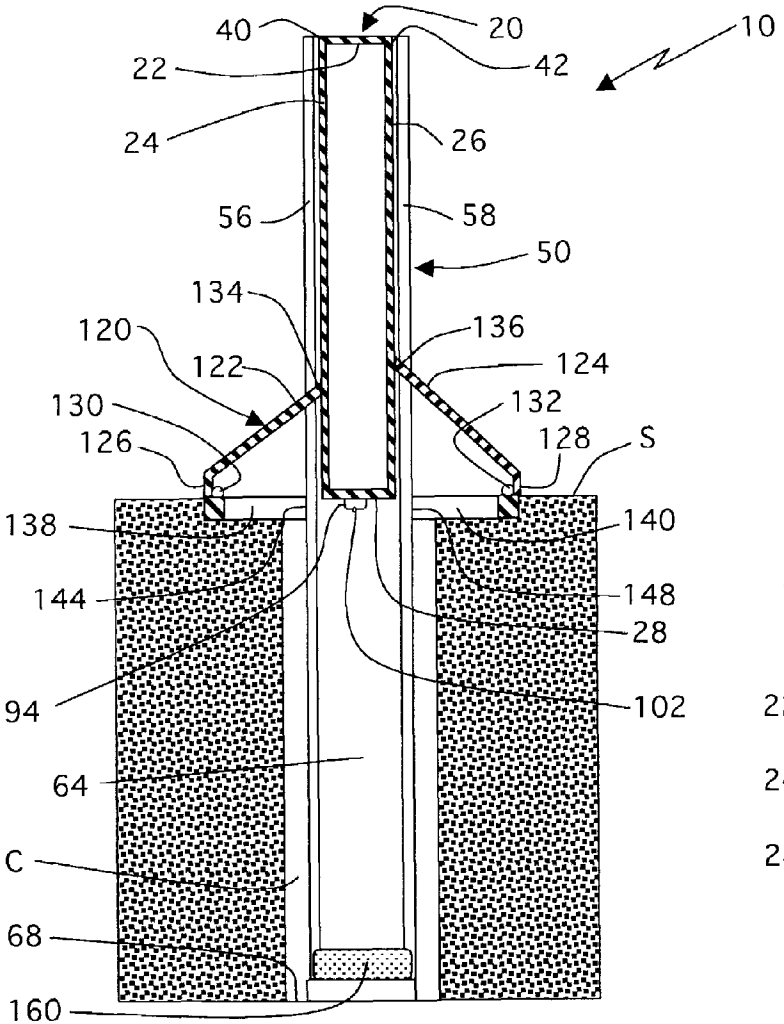
FIG. 1A is a cross sectional view of the instant invention taken along line 1A-1A seen in FIG. 1.

As seen in FIGS. 1, 1A, and 1B, median assembly 20 comprises a substantially flat top wall 22, sidewalls 24 and 26, and base 28. Sidewalls 24 and 26 are in a parallel and spaced apart relationship with respect to each other and they have longitudinal top edges 40 and 42 respectively. Top wall 22 is in a parallel and spaced apart relationship with respect to base 28. Base 28 has ends 30 and 32, seen in FIG. 2B. Median assembly 20 is hollow in a preferred embodiment.

Figure 4:
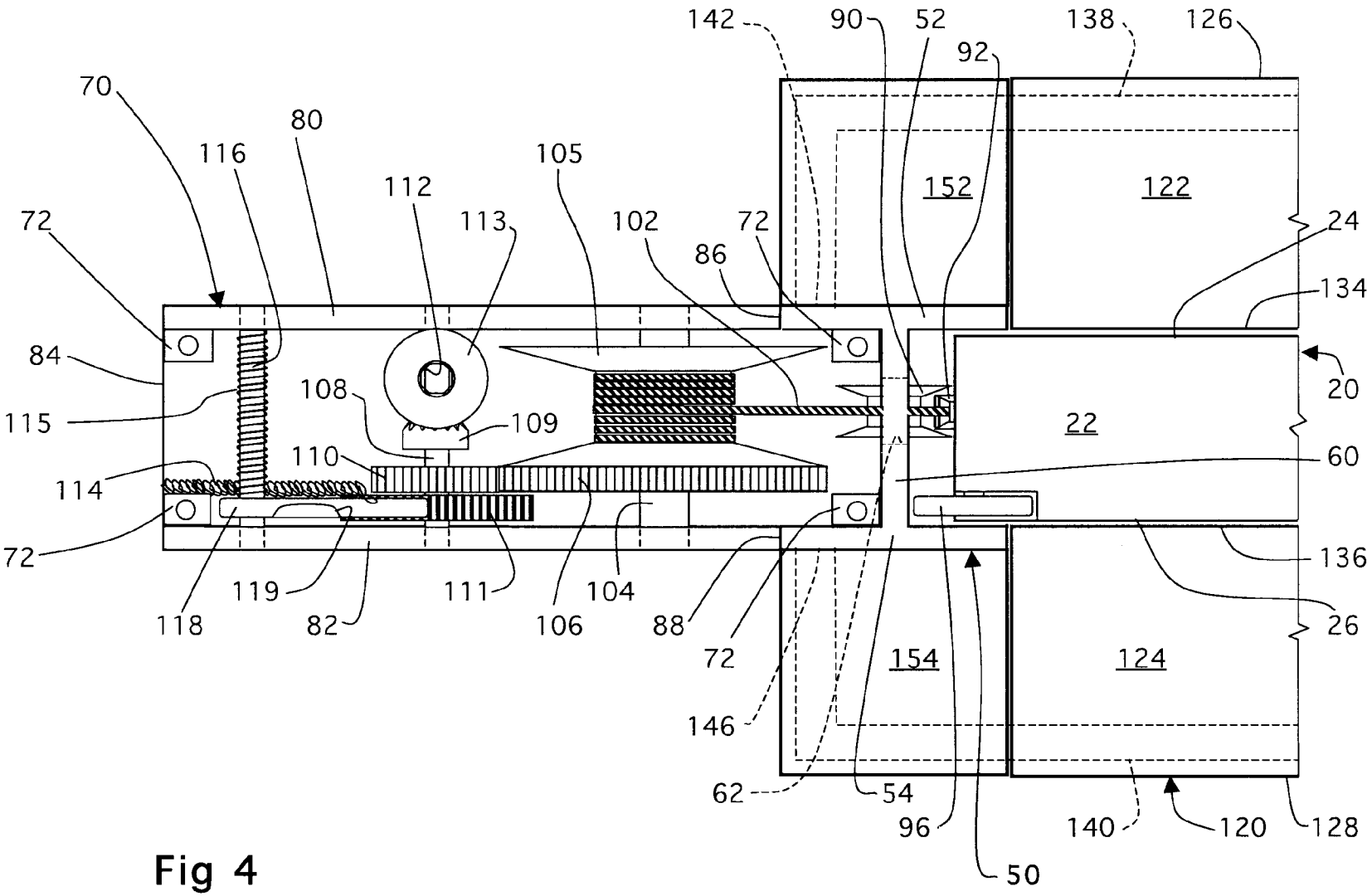
FIG. 4 is a top view of the winch assembly represented in FIG. 3. A top wall has been removed. The frame assembly and the median assembly are partially represented.
Figure 5:
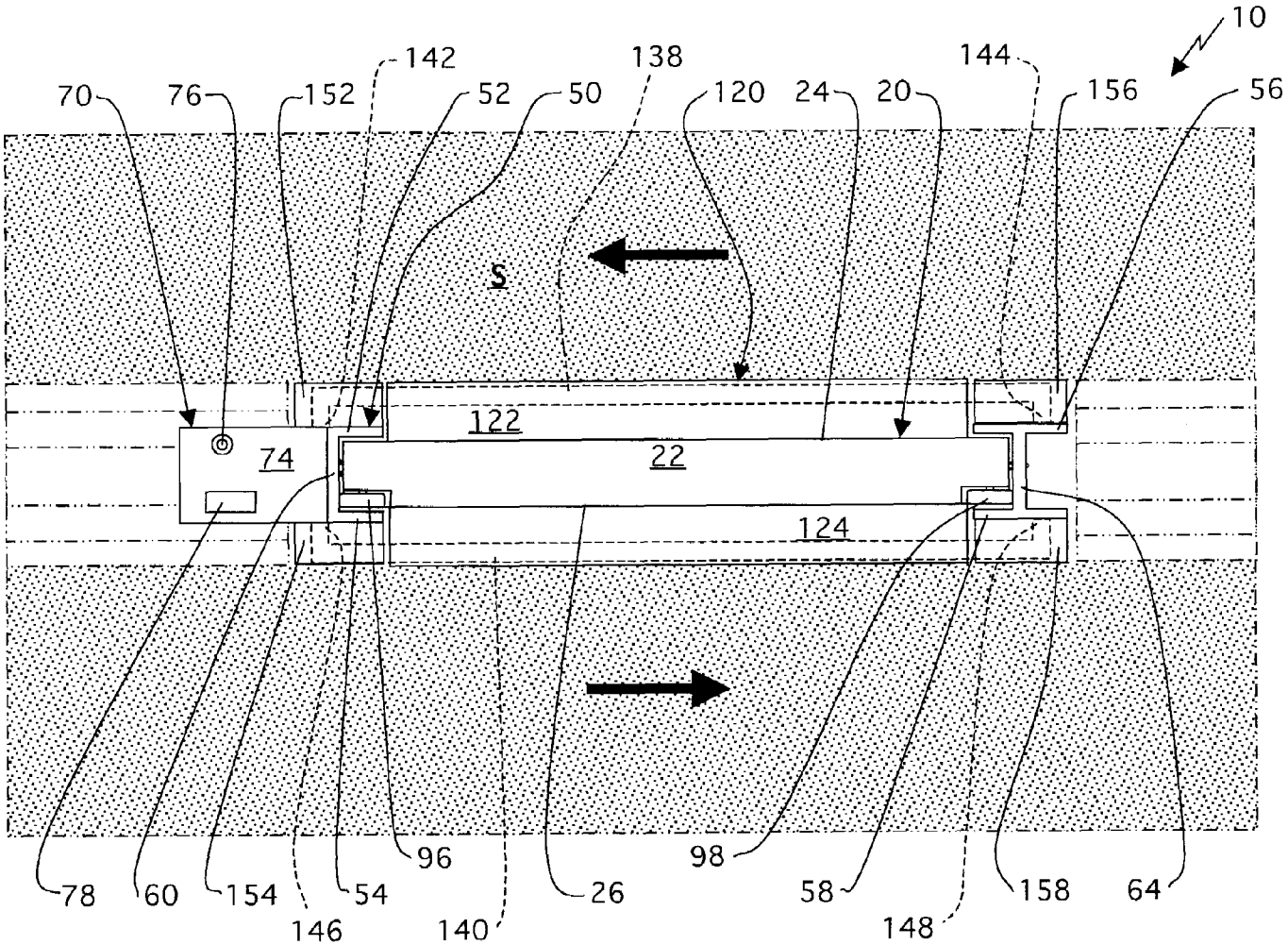
FIG. 5 illustrates a schematic top view of the instant invention in the extracted position to block unauthorized vehicles from crossing it.

Frame assembly 50 comprises side frames 52 and 54 having transversal wall 60 perpendicularly mounted thereto, and side frames 56 and 58 having a transversal wall 64 perpendicularly mounted thereto. Side frames 52 and 54, and transversal wall 60 form an H cross-section. In the same way, side frames 56 and 58 and transversal wall 64 also form an H cross-section. Frame assembly 50 also comprises base 68. Inner portions of the H cross-section structures serve as a channel or rail where median assembly 20 travels vertically upon. Angled lateral walls 152, 154, 156, seen in FIG. 5, and 158 are fixed to side frames 52, 54, 56 and 58, respectively. Transversal wall 60 has through opening 62 adjacent to its top end, as seen in FIG. 4. Transversal wall 64 has through opening 66 at a predetermined distance from its top end. Mounted onto frame assembly 50 is winch assembly 70 that is used to retract and extract median assembly 20 from cavity C, as seen in FIGS. 1A and 1B.

Longitudinal base assembly 120 includes angled lateral walls 122 and 124 with respective sidewalls 126 and 128 extending therefrom, and longitudinal edges 134 and 136. Angled lateral walls 122 and 124 are in a predetermined obtuse angle with respect to side walls 126 and 128. Angled lateral walls 122 and 124 are hingedly mounted to supporting frames 138 and 140 respectively with longitudinal hinges 130 and 132 that are fixed to sidewalls 126 and 128.

As seen in FIG. 1A when median assembly 20 is in the extracted position, sidewalls 126 and 128 are at a substantially vertical disposition and longitudinal edges 134 and 136 rest on sidewalls 24 and 26 respectively. As seen in FIG. 1B, when median assembly 20 is in the retracted position, angled lateral walls 122 and 124 collapse inwardly into a nearly horizontal position and onto top wall 22.

As best seen in FIG. 1B, instant invention 10 is retractably mounted and secured over cavity C. Cavity C is positioned below road surface S and it has cooperative dimensions to receive median assembly 20 therein, when it is in a retracted position.

Figure 2A:
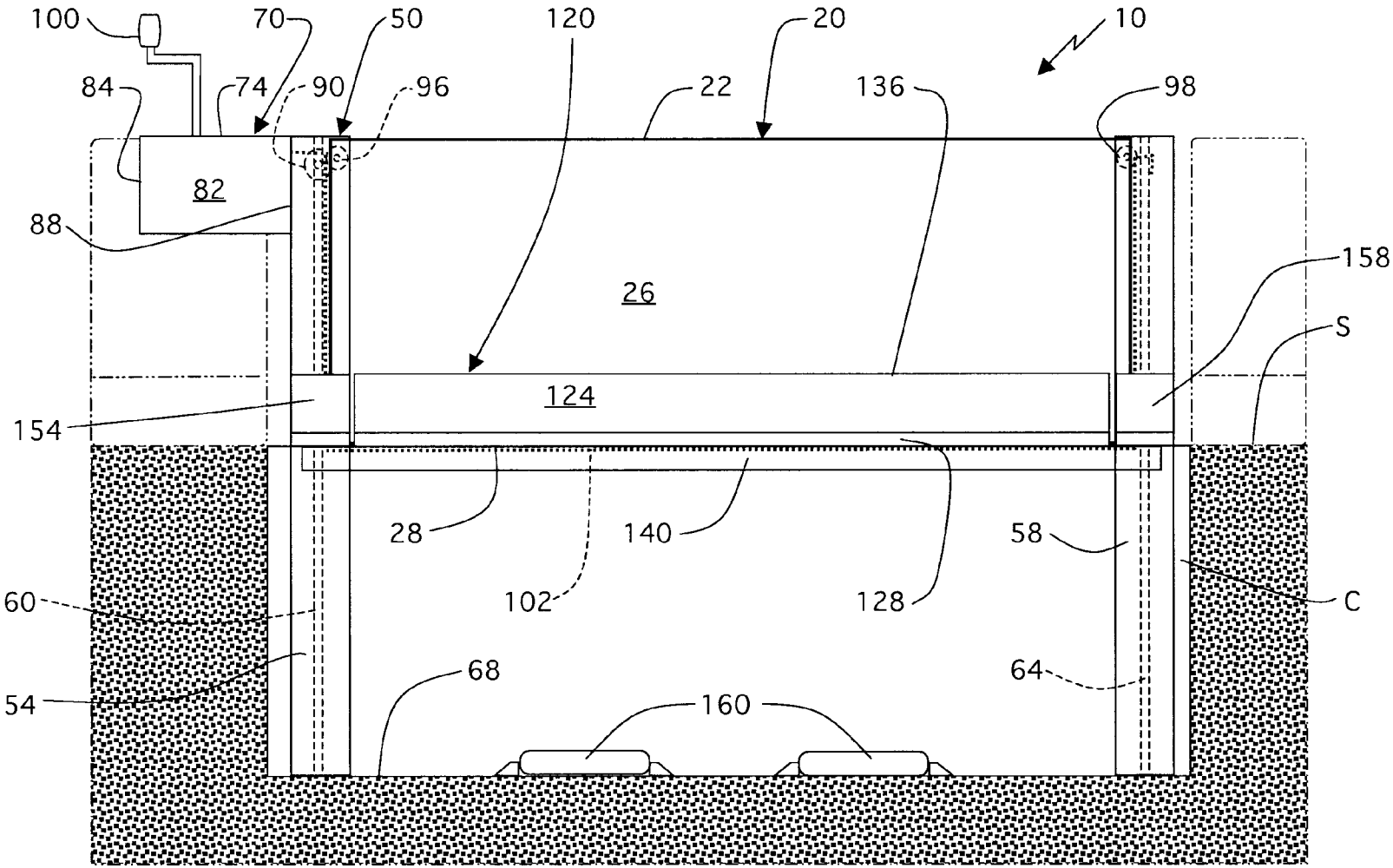
FIG. 2A is a schematic side elevational view of the retractable road median in an extracted position over the road surface.
Figure 2B:
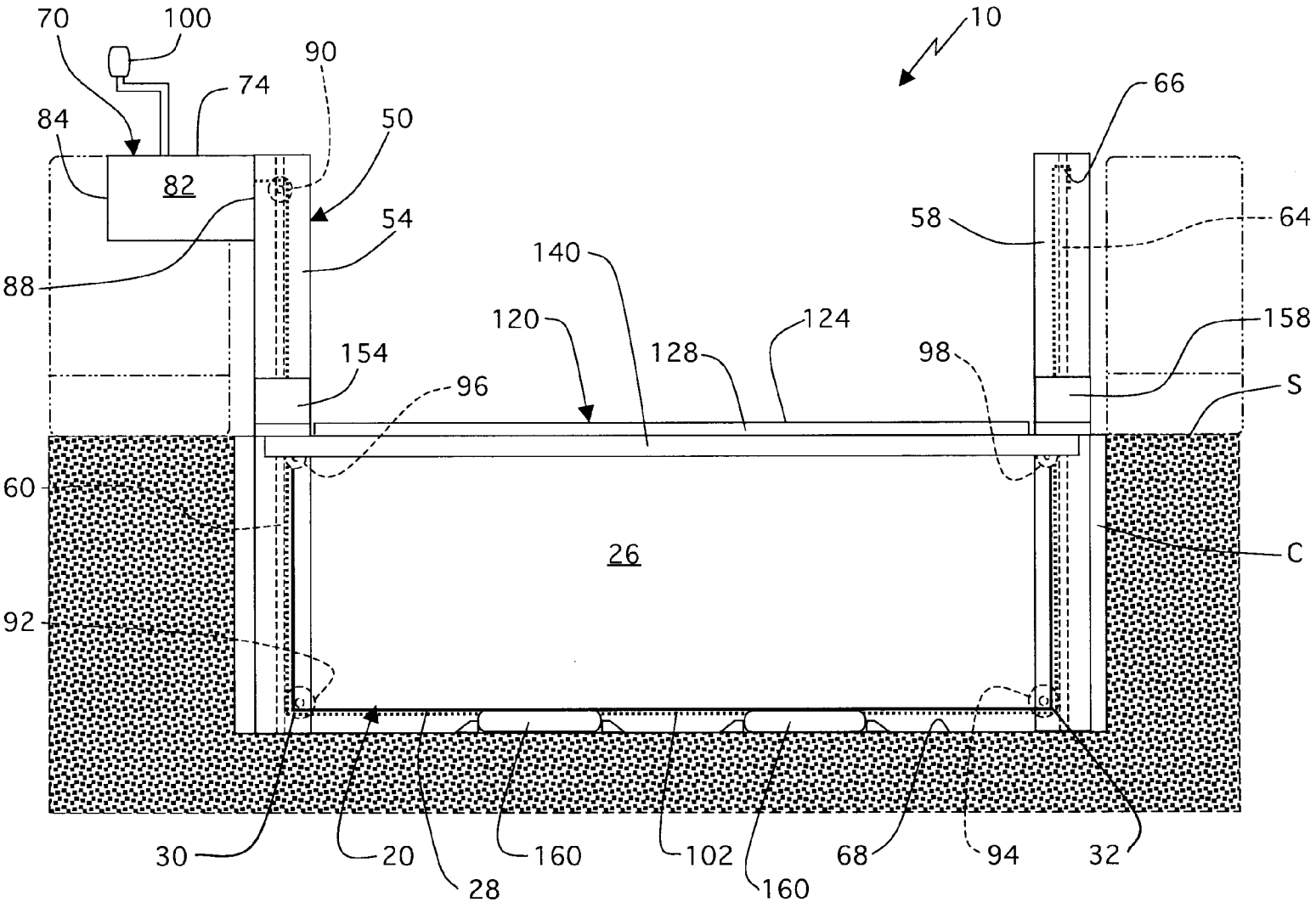
FIG. 2B is a schematic side elevational view of the retractable road median shown in FIG. 2A, in a retracted position and housed within its respective cavity.

As best seen in FIGS. 2A and 2B, pulleys 90, 92 and 94 are positioned to cooperate with cable 102 to vertically move median assembly 20 when winch assembly 70 is actuated. Pulley 90 is mounted adjacent to through opening 62 of transversal wall 60, and pulleys 92 and 94 are mounted in proximity to respective ends 30 and 32 of base 28. Spacer wheels 96 and 98 are rotatably mounted to upper corners of sidewall 26. Spacer wheels 96 and 98 prevent median assembly 20 from erratic movement through interior channels formed by the H cross-section structures.

Figure 3:
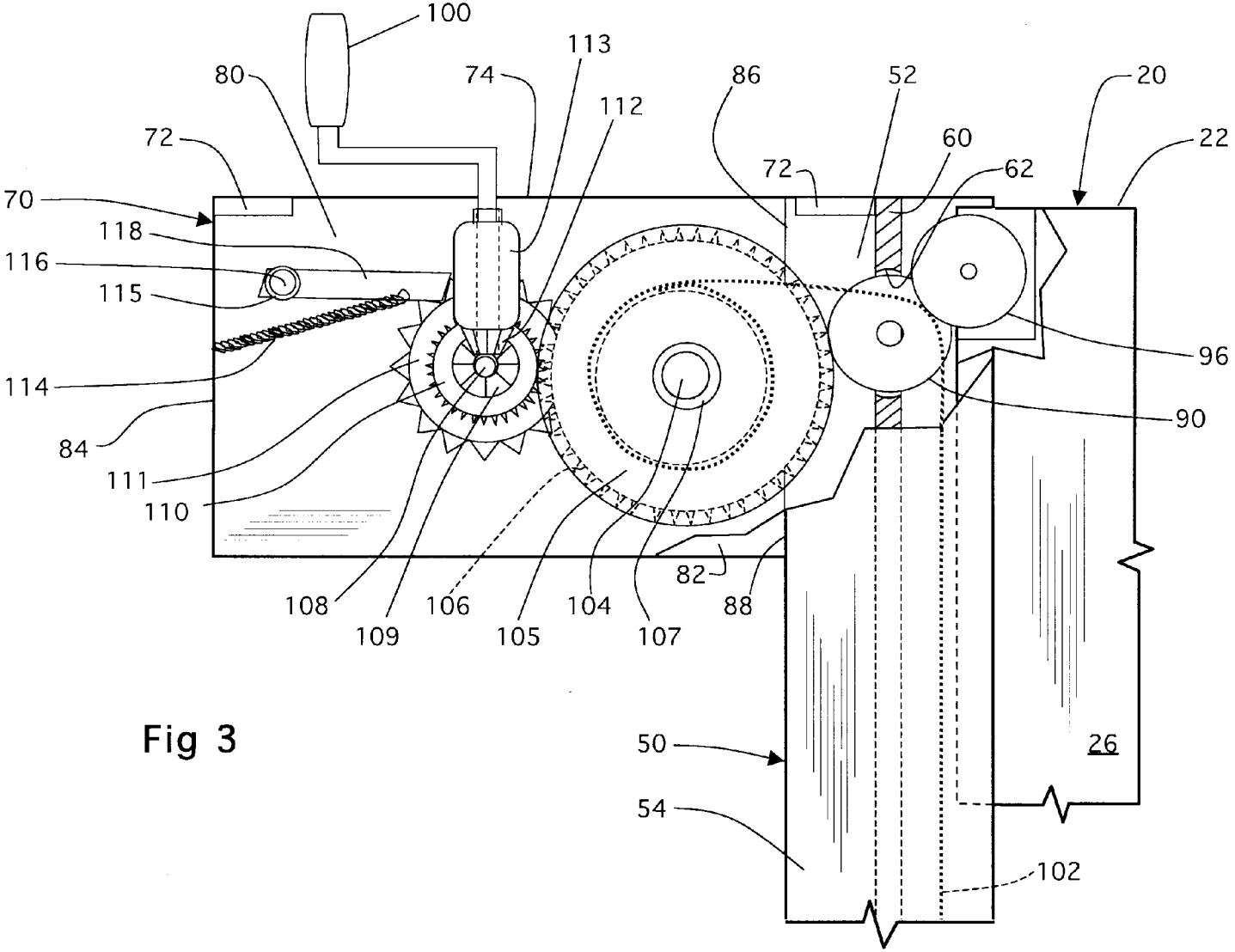
FIG. 3 is a detailed side elevational view of a winch assembly of the instant invention, wherein one of the lateral walls has been partially cross-sectioned. A frame assembly is partially represented and one of its side frames has been partially cross-sectioned. Also, a median assembly is partially represented and one of its sidewalls has been partially cross-sectioned.

As seen in FIGS. 3 and 4, winch assembly 70 has means to move median assembly 20 from the retraced position, seen in FIGS. 1B and 2B, to the extracted position, seen in FIGS. 1 and 1A, and vise versa. Winch assembly 70 is mounted to frame assembly 50, and specifically to side frames 52 and 54 and transversal wall 60 in this embodiment. Winch assembly 70 comprises top wall 74, lateral walls 80 and 82, front wall 84, pulleys 90, 92 and 94, spacer wheels 96 and 98, removable handle 100, cable 102, axle 104, reel 105, axle 108, tapered gear 109, notched wheel 110, ratchet mechanism 111, tapered gear 112, release lever 118, springs 114 and 115 and axle 116.

Lateral walls 80 and 82 are disposed in a parallel and spaced apart relationship with respect to each other. Front wall 84 is perpendicularly mounted to a front edge of lateral walls 80 and 82. Rear edges 86 and 88 of lateral walls 80 and 82, are mounted to side frames 52 and 54 respectively. Top wall 74 is removably mounted to a plurality of securing tabs 72. As best seen in FIG. 1, top wall 74 comprises openings 76 and 78. Opening 76 is cooperatively disposed to receive removable handle 100, and opening 78 has a cooperative shape and dimensions release lever 118 accessibility.

Axle 104 is fixedly secured to lateral walls 80 and 82. Reel 105 is rotatably mounted to axle 104 having bearing 107. Reel 105 comprises notched edge 106. One end of cable 102 is fixed and wound upon reel 105. From reel 105, cable 102 is mounted upon pulleys 90, 92 and 94. Finally, cable 102 passes through opening 66 and is fixed to a predetermined point on transversal wall 64, as best seen in FIG. 2B. Axle 108 is rotatably secured to lateral walls 80 and 82 in a parallel and spaced apart disposition with respect to axle 104. Axle 108 has tapered gear 109 fixedly mounted thereto at a predetermined distance from lateral wall 80. Also fixedly secured to axle 108 and adjacent to tapered gear 109, is notched wheel 110 and ratchet mechanism 111. The notches of notched wheel 110 have a cooperative shape and dimensions to mate with notched edge 106. In addition, notched wheel 110 makes contact with notched edge 106.

Tapered gear 112 is housed in housing 113. Housing 113 is fixed to lateral wall 80. The central opening of tapered gear 112 coincides with opening 76 of top wall 74 to cooperatively receive removable handle 100 therein. Tapered gear 112 extends downwardly into housing 113 and has a cooperative shape and dimensions to mate with tapered gear 109. In addition, tapered gear 112 makes contact with tapered gear 109 and engages when operated by a rotational force from removable handle 100. Axle 116 is fixed to lateral walls 80 and 82 in a parallel and spaced apart disposition with respect to axles 104 and 108. Release lever 118 is pivotally mounted to axle 116 and is kept in place by spring 115 wound around axle 116. A distal end of release lever 118 is cooperatively received by ratchet mechanism 111. Release lever 118 locks ratchet mechanism 111 so that median assembly 20 is kept in place while it is in the extracted position. Spring 114, fixed at one end to front wall 84, provides a downward tension to keep release lever 118 biased against ratchet mechanism 111. Release lever 118 has notch 119. Opening 78, of top wall 74, is cooperatively disposed over release lever 118, so that when median assembly 20 needs to be quickly retracted, such as in emergency events, a user introduces one end of removable handle 100 through notch 119 to disengage release lever 118.

As best seen in FIG. 5, supporting frames 138 and 140 are each in a C-shape. Supporting frame 138 has ends 142 and 144. End 142 is rigidly mounted to side frame 52 at a point that is substantially equidistant from its upper and lower ends. In the same way, end 144 is rigidly mounted to side frame 56 at a point that is substantially equidistant from its upper and lower ends. Supporting frame 140 has ends 146 and 148. End 146 is rigidly mounted to side frame 54 at a point that is substantially equidistant from its upper and lower ends, and end 148 is rigidly mounted to side frame 58 at a point that is substantially equidistant from its upper and lower ends.

In the event of an emergency or when law enforcement vehicles, paramedics, or ambulances need to drive to the other side of an expressway, but can't because of road barriers, median assembly 20 may be lowered into cavity C, under the surface S level, to allow such vehicles to cross to the other side of the expressway. To actuate retractable road median 10, a user introduces one end of removable handle 100 through notch 119 to disengage release lever 118. Once ratchet mechanism 111 is unlocked, the weight of median assembly 20, by gravity, causes it to travel downwardly as cable 102 unwinds, until median assembly 20 is in a fully retracted position. Impact mounts 160, mounted onto base 68, prevent median assembly 20 from impacting base 68. Then, angled lateral walls 122 and 124 rotate and lay in a substantially horizontal position, thus creating a ramp or bridge, to permit rescue, police, and other vehicles to travel over them.

To restore median assembly 20 to the extracted position, the user inserts removable handle 100 into opening 76 and applies a rotational force to rotate tapered gear 112. Tapered gear 112, connected to tapered gear 109, makes axle 108 with notched wheel 110 to rotate, which in turn it causes notched edge 106, connected to reel 105, to rotate. With rotation, cable 102 winds upon reel 105 causing median assembly 20 to extract from cavity C above surface S, as best seen in FIG. 2A. In turn, angled lateral walls 122 and 124 rotate into a substantially vertical position pushed by median assembly 20, and longitudinal edges 134 and 136 rest on side walls 24 and 26 respectively when median assembly 20 is in a fully extracted position. At this position, retractable road median 10 is kept locked by release lever 118 against ratchet mechanism 111.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A retractable road median (10), comprising:

A) a median assembly (20) comprising a substantially flat top wall (22), sidewalls (24) and (26), and base (28), said sidewalls (24) and (26) are in a parallel and spaced apart relationship with respect to each other and they have longitudinal top edges (40) and (42) respectively, said top wall (22) is in a parallel and spaced apart relationship with respect to said base (28), and said base (28) has ends (30) and (32);

B) a frame assembly (50), comprising side frames (52) and (54) having transversal wall (60) perpendicularly mounted thereto, and side frames (56) and (58) having a transversal wall (64) perpendicularly mounted thereto, said side frames (52) and (54), and said transversal wall (60) forming a first H cross-section, and said side frames (56) and (58) and said transversal wall (64) forming a second H cross-section, said frame assembly (50) also comprises base (68), said first and second H cross sections each defining a channel or rail where said median assembly (20) travels vertically upon, said frame assembly (50) further comprising angled lateral walls (152), (154), (156), and (158) that are fixed to said side frames (52), (54), (56) and (58), respectively, said transversal wall (60) has a through opening (62), and said transversal wall (64) has through opening (66);

C) a longitudinal base assembly (120) comprising angled lateral walls (122) and (124) with respective sidewalls (126) and (128) extending therefrom, and longitudinal edges (134) and (136), said angled lateral walls (122) and (124) are in a predetermined obtuse angle with respect to said side walls (126) and (128), and said angled lateral walls (122) and (124) are hingedly mounted to supporting frames (138) and (140) respectively with longitudinal hinges (130) and (132) that are fixed to said sidewalls (126) and (128); and D) a winch assembly (70) having means to retract said median assembly (20) into a cavity below a surface traveled upon by motor vehicles from an extracted position to a retracted position, to allow said motor vehicles to cross over it, and vise versa.

2. The retractable road median (10) set forth in claim 1, further characterized in that said median assembly (20) serves as a traffic barrier for controlling a flow of said motor vehicles between opposing traffic lanes on said surface.

3. The retractable road median (10) set forth in claim 1, further characterized in that said sidewalls (126) and (128) are at a substantially vertical disposition and said longitudinal edges (134) and (136) rest on said sidewalls (24) and (26) respectively when said median assembly (20) is in said extracted position.

4. The retractable road median (10) set forth in claim 1, further characterized in that said angled lateral walls (122) and (124) collapse inwardly into a nearly horizontal position and onto said top wall (22) when said median assembly (20) is in said retracted position.

5. The retractable road median (10) set forth in claim 1, further characterized in that said frame assembly (50) comprises at least one impact mount (160) mounted onto said base (68).

6. The retractable road median (10) set forth in claim 1, further characterized in that said winch assembly (70) comprises pulleys (90), (92) and (94) that are positioned to cooperate with cable (102) to vertically move said median assembly (20) when said winch assembly (70) is actuated, said pulley (90) is mounted adjacent to through said opening (62) of said transversal wall (60), and said pulleys (92) and (94) are mounted in proximity to respective said ends (30) and (32) of said base (28), said winch assembly (70) further comprises spacer wheels (96) and (98) that are rotatably mounted to upper corners of said sidewall (26), said spacer wheels (96) and (98) prevent said median assembly (20) from erratic movement through each of said channel or rail.

7. The retractable road median (10) set forth in claim 6, further characterized in that said means to retract said median assembly (20) into said cavity below said surface traveled upon by said motor vehicles from said extracted position includes introducing a removable handle (100) to disengage a release lever thus allowing said median assembly (20) to travel downwardly by gravity as said cable (102) unwinds, until said median assembly (20) is in said retracted position as said angled lateral walls (122) and (124) rotate and lay in a substantially horizontal position, thus creating a ramp or bridge, to permit said motor vehicles to travel over them.

8. The retractable road median (10) set forth in claim 7, further characterized in that said means to extract said median assembly (20) from said cavity below said surface traveled upon by said motor vehicles from said extracted position includes introducing said removable handle (100) to apply a rotational force, causing said cable (102) to wind upon a reel until said median assembly (20) is in a fully said extracted position as said sidewalls (126) and (128) are at a substantially vertical disposition and said longitudinal edges (134) and (136) rest on said sidewalls (24) and (26) respectively.

9. A retractable road median (10), comprising:

A) a median assembly (20) comprising a substantially flat top wall (22), sidewalls (24) and (26), and base (28), said sidewalls (24) and (26) are in a parallel and spaced apart relationship with respect to each other and they have longitudinal top edges (40) and (42) respectively, said top wall (22) is in a parallel and spaced apart relationship with respect to said base (28), and said base (28) has ends (30) and (32), said median assembly (20) serves as a traffic barrier for controlling a flow of said motor vehicles between opposing traffic lanes on said surface;

B) a frame assembly (50), comprising side frames (52) and (54) having transversal wall (60) perpendicularly mounted thereto, and side frames (56) and (58) having a transversal wall (64) perpendicularly mounted thereto, said side frames (52) and (54), and said transversal wall (60) forming a first H cross-section, and said side frames (56) and (58) and said transversal wall (64) forming a second H cross-section, said frame assembly (50) also comprises base (68), said first and second H cross sections each defining a channel or rail where said median assembly (20) travels vertically upon, said frame assembly (50) further comprising angled lateral walls (152), (154), (156), and (158) that are fixed to said side frames (52), (54), (56) and (58), respectively, said transversal wall (60) has a through opening (62), and said transversal wall (64) has through opening (66);

C) a longitudinal base assembly (120) comprising angled lateral walls (122) and (124) with respective sidewalls (126) and (128) extending therefrom, and longitudinal edges (134) and (136), said angled lateral walls (122) and (124) are in a predetermined obtuse angle with respect to said side walls (126) and (128), and said angled lateral walls (122) and (124) are hingedly mounted to supporting frames (138) and (140) respectively with longitudinal hinges (130) and (132) that are fixed to said sidewalls (126) and (128), said sidewalls (126) and (128) are at a substantially vertical disposition and said longitudinal edges (134) and (136) rest on said sidewalls (24) and (26) respectively when said median assembly (20) is in said extracted position; and D) a winch assembly (70) having means to retract said median assembly (20) into a cavity below a surface traveled upon by motor vehicles from an extracted position to a retracted position, to allow said motor vehicles to cross over it, and vise versa.

10. The retractable road median (10) set forth in claim 9, further characterized in that said angled lateral walls (122) and (124) collapse inwardly into a nearly horizontal position and onto said top wall (22) when said median assembly (20) is in said retracted position.

11. The retractable road median (10) set forth in claim 10, further characterized in that said frame assembly (50) comprises at least one impact mount (160) mounted onto said base (68).

12. The retractable road median (10) set forth in claim 11, further characterized in that said winch assembly (70) comprises pulleys (90), (92) and (94) that are positioned to cooperate with cable (102) to vertically move said median assembly (20) when said winch assembly (70) is actuated, said pulley (90) is mounted adjacent to through said opening (62) of said transversal wall (60), and said pulleys (92) and (94) are mounted in proximity to respective said ends (30) and (32) of said base (28), said winch assembly (70) further comprises spacer wheels (96) and (98) that are rotatably mounted to upper corners of said sidewall (26), said spacer wheels (96) and (98) prevent said median assembly (20) from erratic movement through each of said channel or rail.

13. The retractable road median (10) set forth in claim 12, further characterized in that said means to retract said median assembly (20) into said cavity below said surface traveled upon by said motor vehicles from said extracted position includes introducing a removable handle (100) to disengage a release lever thus allowing said median assembly (20) to travel downwardly by gravity as said cable (102) unwinds, until said median assembly (20) is in said retracted position as said angled lateral walls (122) and (124) rotate and lay in a substantially horizontal position, thus creating a ramp or bridge, to permit said motor vehicles to travel over them.

14. The retractable road median (10) set forth in claim 13, further characterized in that said means to extract said median assembly (20) from said cavity below said surface traveled upon by said motor vehicles from said extracted position includes introducing said removable handle (100) to apply a rotational force, causing said cable (102) to wind upon a reel until said median assembly (20) is in a fully said extracted position as said sidewalls (126) and (128) are at a substantially vertical disposition and said longitudinal edges (134) and (136) rest on said sidewalls (24) and (26) respectively.

* * * * *